US007469432B2

(12) United States Patent
Chambers

(10) Patent No.: US 7,469,432 B2
(45) Date of Patent: Dec. 30, 2008

(54) METHOD AND APPARATUS FOR IMPROVING AIR FLOW UNDER A PATIENT

(75) Inventor: Kenith W. Chambers, Batesville, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 336 days.

(21) Appl. No.: 11/243,664

(22) Filed: Oct. 5, 2005

(65) Prior Publication Data

US 2006/0080778 A1 Apr. 20, 2006

Related U.S. Application Data

(60) Provisional application No. 60/616,246, filed on Oct. 6, 2004, provisional application No. 60/567,215, filed on Apr. 30, 2004.

(51) Int. Cl.
*A47C 27/08* (2006.01)

(52) U.S. Cl. ..... 5/423; 5/691; 5/726; 607/104

(58) Field of Classification Search ..... 5/421, 5/423, 726, 713, 691, 652.1; 297/180.11, 297/18; 607/104
See application file for complete search history.

(56) References Cited

U.S. PATENT DOCUMENTS

| | | | | |
|---|---|---|---|---|
| 1,332,933 | A | 3/1920 | Sylvester | |
| 4,839,512 | A | 6/1989 | Speck | |
| 5,060,174 | A | 10/1991 | Gross | |
| 5,117,518 | A | 6/1992 | Schild | |
| 5,180,619 | A | 1/1993 | Landi et al. | |
| 5,269,030 | A | 12/1993 | Pahno et al. | |
| 5,444,881 | A | 8/1995 | Landi et al. | |
| 5,473,783 | A * | 12/1995 | Allen | 5/652.2 |
| 5,596,781 | A | 1/1997 | Graebe | |
| 5,689,845 | A | 11/1997 | Sobieralski | |
| 5,731,062 | A | 3/1998 | Kim et al. | |
| 5,817,391 | A * | 10/1998 | Rock et al. | 428/86 |
| 5,833,321 | A | 11/1998 | Kim et al. | |
| 5,840,400 | A | 11/1998 | Landi et al. | |
| 5,845,352 | A | 12/1998 | Matsler et al. | |
| 5,851,930 | A | 12/1998 | Bessey et al. | |
| 5,870,785 | A * | 2/1999 | Hoorens | 5/652.1 |
| 5,873,137 | A | 2/1999 | Yavets-Chen | |
| 5,882,322 | A | 3/1999 | Kim et al. | |
| 5,896,680 | A | 4/1999 | Kim et al. | |
| 5,917,180 | A | 6/1999 | Reimer et al. | |
| 5,926,884 | A * | 7/1999 | Biggie et al. | 5/714 |
| D412,685 | S | 8/1999 | Bar et al. | |
| D413,085 | S | 8/1999 | Bar et al. | |

(Continued)

FOREIGN PATENT DOCUMENTS

| | | |
|---|---|---|
| DE | 29502025 | 6/1996 |

(Continued)

OTHER PUBLICATIONS

Search report dated Jan. 16, 2006 from EP 05 25 6213.

*Primary Examiner*—Michael Trettel
(74) *Attorney, Agent, or Firm*—Barnes & Thornburg LLP

(57) ABSTRACT

An overlay for a patient support is provided. The overlay is coupled to an air supply and includes an air permeable three-dimensional fiber network.

26 Claims, 4 Drawing Sheets

U.S. PATENT DOCUMENTS

| | | | | |
|---|---|---|---|---|
| D413,841 | S | 9/1999 | Bar et al. | |
| 5,954,402 | A | 9/1999 | McInturff | |
| D415,567 | S | 10/1999 | Bar | |
| 5,970,789 | A | 10/1999 | Meyer et al. | |
| 5,972,477 | A | 10/1999 | Kim et al. | |
| 5,984,418 | A | 11/1999 | McInturff | |
| 6,007,898 | A | 12/1999 | Kim et al. | |
| 6,014,346 | A | 1/2000 | Malone | |
| 6,085,369 | A * | 7/2000 | Feher | 5/423 |
| 6,095,611 | A | 8/2000 | Bar et al. | |
| 6,145,142 | A | 11/2000 | Rechin et al. | |
| 6,165,142 | A | 12/2000 | Bar | |
| 6,182,315 | B1 * | 2/2001 | Lee | 5/690 |
| 6,212,718 | B1 | 4/2001 | Stolpmann et al. | |
| 6,269,504 | B1 | 8/2001 | Romano et al. | |
| 6,306,483 | B1 | 10/2001 | Bessey et al. | |
| 6,378,948 | B1 * | 4/2002 | Macher et al. | 297/452.28 |
| 6,403,196 | B1 | 6/2002 | Bessey et al. | |
| 6,474,743 | B1 | 11/2002 | Harker et al. | |
| 6,487,739 | B1 | 12/2002 | Harker | |
| 6,560,804 | B2 | 5/2003 | Wise et al. | |
| 6,564,410 | B2 | 5/2003 | Graebe et al. | |
| 6,568,273 | B2 | 5/2003 | Reimer | |
| 6,593,588 | B1 | 7/2003 | Reimer | |
| 6,623,080 | B2 | 9/2003 | Clapper | |
| 6,646,556 | B1 | 11/2003 | Smith et al. | |
| 6,687,936 | B2 | 2/2004 | Graebe et al. | |
| 6,687,937 | B2 | 2/2004 | Harker | |
| 6,701,556 | B2 | 3/2004 | Romano et al. | |
| 6,782,574 | B2 | 8/2004 | Totton et al. | |
| 7,100,978 | B2 * | 9/2006 | Ekern et al. | 297/180.11 |
| 2005/0086739 | A1 * | 4/2005 | Wu | 5/423 |

FOREIGN PATENT DOCUMENTS

| | | | |
|---|---|---|---|
| DE | 10316162 | A1 | 10/2004 |
| DE | 10333742 | A1 | 2/2005 |
| EP | 0853918 | A2 | 7/1998 |
| WO | WO03/041538 | | 5/2003 |
| WO | WO2005/013878 | | 2/2005 |

* cited by examiner

METHOD AND APPARATUS FOR IMPROVING AIR FLOW UNDER A PATIENT

RELATED APPLICATIONS

This application claims the benefit of U.S. Provisional Patent Application Ser. No. 60/616,246, filed Oct. 6, 2004, which is incorporated herein by this reference.

This application is related to U.S. patent application Ser. No. 11/119,980, filed May 2, 2005, which claims the benefit of U.S. Provisional Patent Application Ser. No. 60/567,215, filed Apr. 30, 2004, both of which are assigned to the assignee of the present invention and expressly incorporated by reference herein.

TECHNICAL FIELD

The present invention relates to an overlay for a patient support such as a sleeping and/or seating surface (i.e. a hospital bed, mattress, pad, cushion, or bladder). The present invention also relates to method for improving air flow under a patient supported by a patient support.

BACKGROUND

Hospital beds include a variety of types of mattresses that may have inflatable portions or may be filled with three dimensional engineered material, traditional foam, or other suitable fill material. Hospital beds are often articulatable; for example, the head and/or foot sections may be raised or lowered. In addition, hospital beds often include features directed to the prevention/treatment of decubitus ulcers (bedsores), and/or therapies such as pulmonary rotational therapy, or percussion/vibration therapy. Additionally, it is known to use inflatable mattresses with a variety of inflatable cell/zone structures.

Exemplary hospital beds and mattresses are disclosed in, for example, U.S. Pat. No. 4,949,413 to Goodwin, U.S. Pat. No. 5,647,079 to Hakamiun et al., U.S. Pat. No. 6,269,504 to Romano et al., and U.S. Pat. No. 5,926,884 to Biggie et al., which are all assigned to the assignee of the present invention and all of which are expressly incorporated by reference herein.

SUMMARY

In accordance with the present invention, an overlay, cover, pad or coverlet for a patient support is provided. In one embodiment, a mattress overlay is provided. The overlay includes a cover, a base coupled to the cover, an interior region defined by the base and the cover, a valve operably coupled to the interior region, an air supply operably coupled to the valve and configured to provide air to the interior region, and a fiber network located within the interior region. The fiber network includes a top portion, a bottom portion, and a middle portion. The middle portion includes a plurality of fibers and air spaces, the fibers each having a first portion coupled to the top portion and a second portion coupled to the bottom portion. The cover may include a plurality of apertures configured to allow air to pass through the cover. The base may be formed from a breathable material. The top and bottom portions may include a woven material. The fiber network may include resilient fibers. The fiber network may be stretchable in at least two directions.

The mattress overlay may include first and second spaced apart longitudinal sides and first and second spaced apart ends, and the fiber network may be secured to at least one of the sides and ends. The fiber network may be secured by at least one coupler within the interior region.

The mattress overlay may include first and second spaced apart longitudinal sides and first and second spaced apart ends defined by the dimensions of the base and the cover and the dimensions of the base and the cover are sized to support at least a portion of a patient. The dimensions may be sized to correspond to the dimensions of a patient support upon which the mattress overlay is to be placed.

The mattress overlay may include first and second spaced apart longitudinal sides and first and second spaced apart ends and the valve may be coupled to the first end.

The mattress overlay may further include an outlet valve coupled to the second end.

In another embodiment, a mattress overlay is provided, including a cover defining an interior region, a three-dimensional fiber network located in the interior region, an inlet valve coupled to the interior region, an air supply coupled to the inlet valve, and a controller coupled to the inlet valve and the air supply to control air flow from the air supply to the interior region of the overlay.

The cover may include a top portion and a bottom portion coupled to the top portion at an edge, and the cover has first and second spaced apart longitudinal sides and first and second spaced apart ends. The three dimensional fiber network may be coupled to at least one of the sides and ends of the cover. The fiber network may have an outer edge substantially aligned with the edge of the cover.

The level of air flow from the air supply to the controller may be adjustable. The overlay may further include a sensor located within the interior region, wherein the sensor detects a condition and transmits information about the condition to the controller, and the controller adjusts the air flow from the air supply to the interior region based on information received by the controller. The condition may be at least one of: humidity within the interior region, air pressure within the interior region, pressure at an interface between the cover and a patient positioned on the overlay, temperature within the interior region, and weight of a patient positioned on the overlay. The controller may include an input device. The controller may receive input through the input device from one of a patient and a caregiver and the controller may adjust the air flow from the air supply to the interior region based on the input.

In another embodiment, a method of improving air flow under a patient is provided. The method includes the steps of providing a patient support configured to support a patient; providing an overlay, the overlay including a cover having a plurality of apertures, a base coupled to the cover, an interior region defined by the cover and the base, and a fiber network located within the interior region; positioning the overlay above the patient support; and forcing air from a air supply into the interior region allowing air to exit the interior region through the plurality of apertures.

Additional features and advantages of the invention will become apparent to those skilled in the art upon consideration of the following detailed description of illustrated embodiments exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments described below and shown in the figures are exemplary and are not intended to limit the invention to the precise forms disclosed. Instead, the embodiments were selected for description to enable one of ordinary skill in the art to practice the invention.

In accordance with the present invention, an overlay is provided to improve air flow under a patient positioned on a patient support. The patient support is, for example, a bed or a chair. The illustrated embodiments of the overlay are sized to substantially coincide with the area of the patient support that is configured to support a patient. The overlay may take the form of a pad, coverlet, mattress insert, fitted cover or fitted sheet, or similar suitable configuration. The overlay is positionable on top of a mattress or cushion. The overlay is also positionable within the interior region of a mattress. In certain embodiments, the length and width dimensions of the overlay substantially correspond to the length and width dimensions of a patient support on which the overlay may be positioned.

Figure 1:
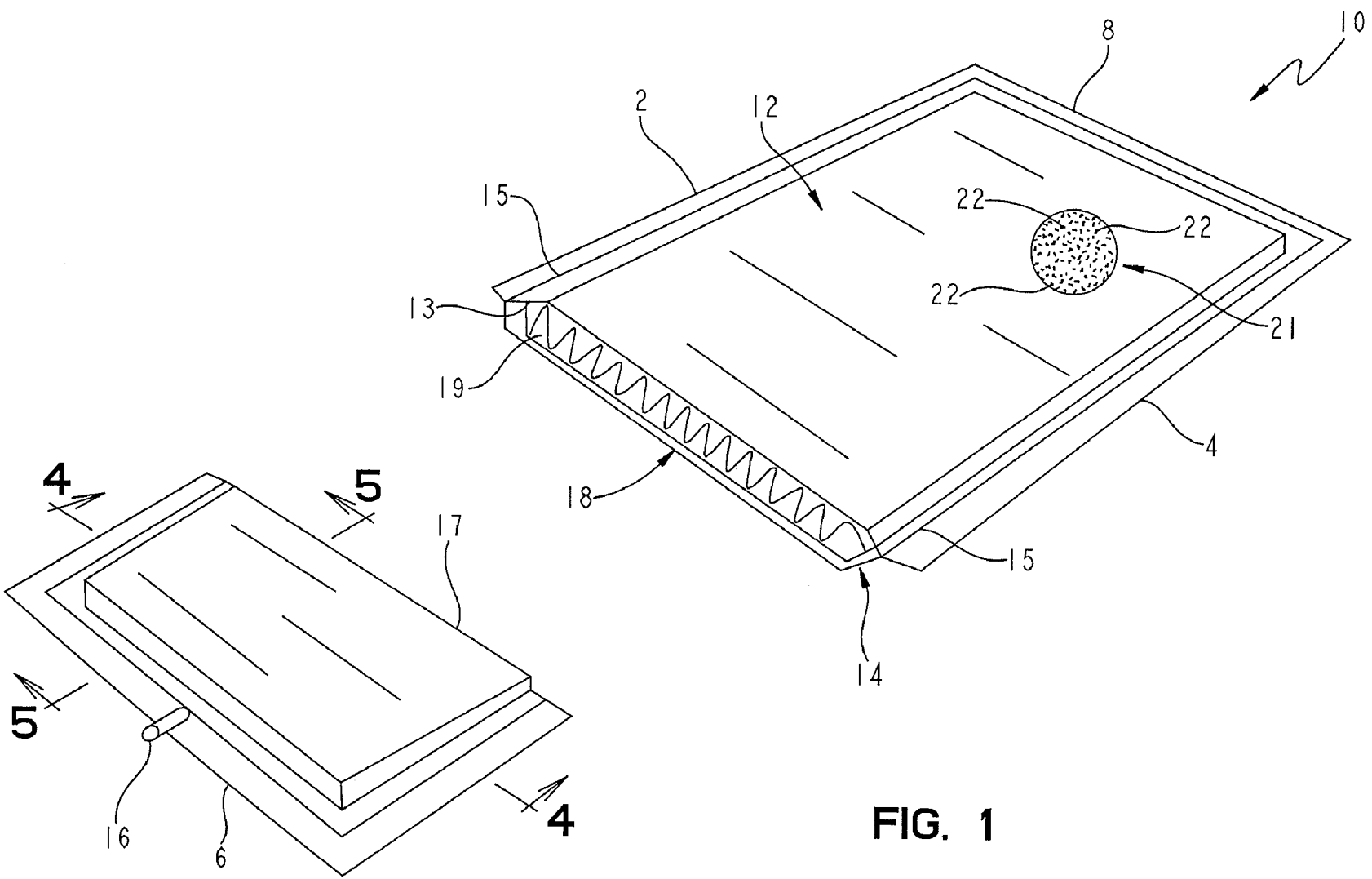
FIG. 1 is a perspective view of a mattress overlay including a cutaway portion showing a cross section of an interior region, a three dimensional engineered material located within the interior region, and a cover including a magnified portion showing a plurality of apertures.

As shown in FIG. 1, a mattress overlay 10 includes a cover or top layer 12, a base or bottom layer 14 coupled to cover 12, an edge 15, an inlet valve 16 and an interior region 18 defined between cover 12 and base 14, shown at cutaway portion 17. Interior region 18 includes a three dimensional engineered material or 3D layer 19.

In one illustrative embodiment, 3D layer 19 includes a fiber network formed of a woven, knitted, or non-woven spacer fabric which is soft and flexible and/or comprises thermoplastic fibers or monofilaments. One example of such a material is manufactured by SpaceNet, Inc. of Monroe, N.C. In one embodiment, the three-dimensional material is a breathable monofilament polyester mesh fabric that is formed into various three-dimensional patterns after weaving, manufactured by SpaceNet, Inc. In general, the spacer fabric is stretchable in at least two directions. In other embodiments, the 3D material includes a plurality of resilient or compressible projections and depressions.

In other embodiments, 3D layer 19 is a three-dimensional fiber network or knit material, such as Tytex manufactured by Tytex Group (Tytex Inc. of Rhode Island, U.S.A.). In still other embodiments, a three-dimensional knit material such as Tytex is used in addition to the SpaceNet or other three-dimensional material. The three dimensional material 19 may include multiple layers such as is described in U.S. patent application Ser. No. 11/119,980, which is incorporated herein by reference.

Illustratively, cover 12 is coupled to base 14 at edge 15 through radio-frequency (RF) welding. Alternatively, cover 12 is coupled to base 14 at edge 15 by glue or any substantially air tight sealing known to those skilled in the art.

Cover 12 includes a first longitudinal side 2, a second longitudinal side 4, a first end 6, and a second end 8. The 3D layer is coupled to the overlay at one or more points 13 located along the longitudinal sides 2, 4 and/or the ends 6, 8, by stitching or other suitable fastener. Alternatively or in addition, 3D layer 19 is coupled to the overlay at other points, for example, in a quilted configuration. In general, the 3D layer is secured within interior region 18 so as to prevent movement or slippage, for example, as a section of a patient support is articulated or with movement or repositioning of a patient positioned above the overlay 10.

Valve 16 is illustratively positioned at about the center point of first end 6. Value 16 may be located anywhere on either end 6, 8 or side 2, 4 may be desirable for a particular overlay application. In addition, ore than one inlet valve 16 may be provided.

In one illustrative embodiment, cover 12 includes a breathable material such as nylon, with micro vents, apertures or holes 22 creating a low air loss surface. In FIG. 1, holes 22 are shown in magnified portion 21 of cover 12. A low air loss surface allows a limited supply of air to escape through cover 12. In general, low air loss surfaces provide improved support and comfort for a patient and provide a cooling air flow to dry perspiration of the patient. As illustrated, the plurality of holes 22 are configured to allow a limited supply of air to escape cover 12.

In other embodiments, cover 12 is formed from an air permeable or air impermeable material. In certain embodiments, air permeable material is undercoated with a waterproof but vapor permeable material such as urethane. In an alternative embodiment, cover 12 is perforated allowing air to flow from cover 12. In still other embodiments, cover 12 includes 70d nylon.

In one illustrative embodiment, base 14 is made from a breathable material such as 70d nylon combined with a vapor permeable material such as urethane. In a particular embodiment, a urethane coating of less than about ½ millimeter is used. This allows moisture or sweat from the patient to pass or evaporate through the bottom layer 14. In other embodiments, base 14 is made from plastic, vinyl or any other breathable material. In alternative embodiments, a moisture barrier layer is provided above or below base 14 to capture moisture from the patient allowing base 14 to be made from a non-breathable material.

Figure 2:
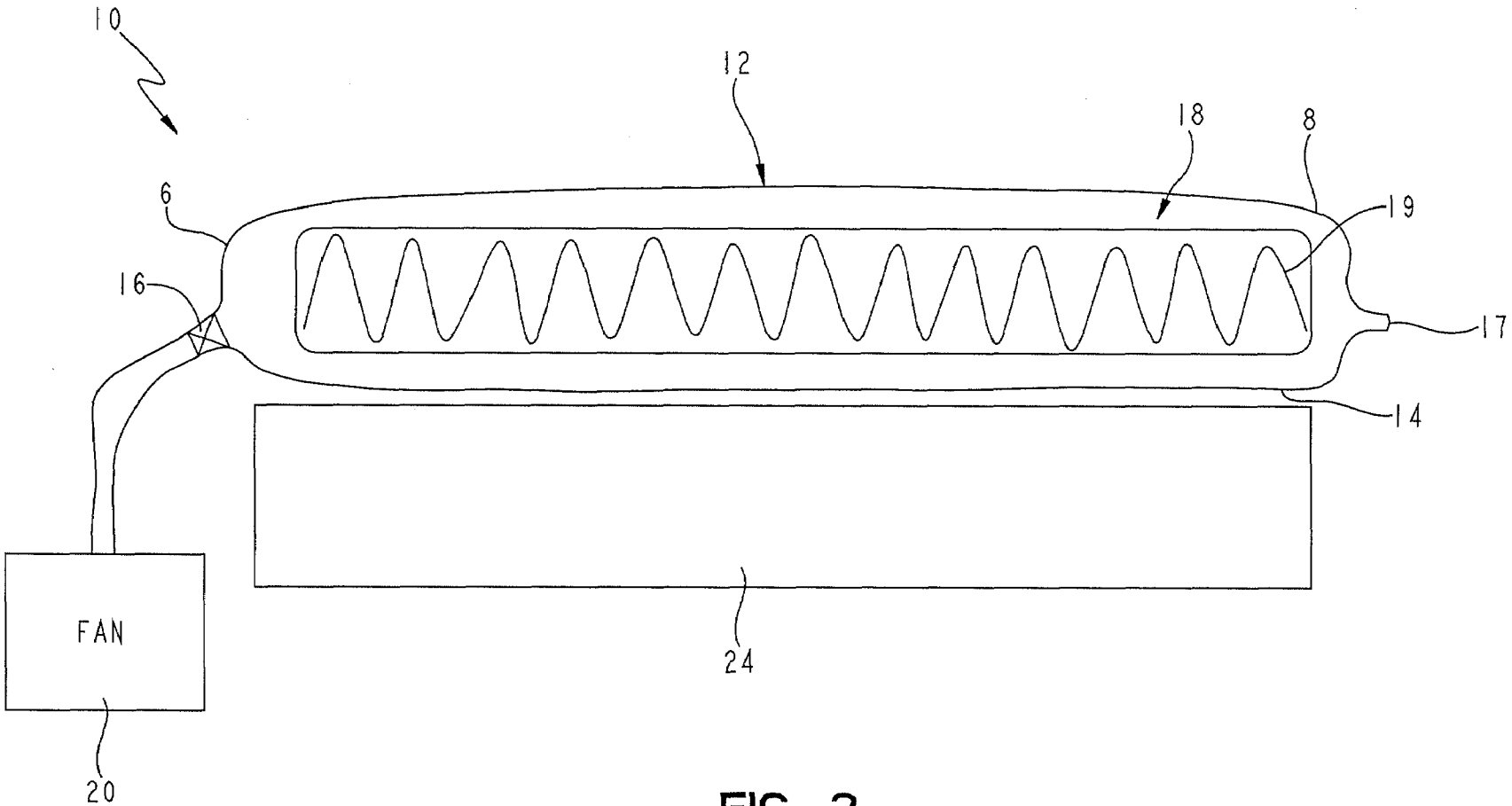
FIG. 2 is a diagrammatic end view of another mattress overlay connected to an air source and placed over a mattress.

As shown in FIG. 2, overlay 10 is configured to be placed on a patient support 24. In alternative embodiments, overlay 10 is used independently of patient support 24, or integrated with patient support 24, such as by sewing, adhesion, snaps, buttons, Velcro®, hook and loop fasteners, or other suitable coupling means. Illustratively, mattress 24 is a foam mattress. In alternative embodiments, mattress 24 is an inflatable bladder filled with air, gel, three dimensional engineered material or other suitable support material, or a combination of such materials.

As shown in FIG. 2, valve 16 is operably coupled to an air supply 20 at first end 6. Air supply 20 is configured to force or otherwise provide air to interior region 18. An illustrative example of valve 16 is provided in U.S. Pat. No. 6,418,579 to Perez et al., which is assigned to the assignee of the present invention and the disclosure of which is expressly incorporated by reference herein. In alternative embodiments, valve 16 can be a quick release valve, a check valve, or any other type of connection between an air supply and an interior region of an overlay or mattress known to those of ordinary skill in the art.

An illustrative embodiment of air supply 20 is an adjustable brushless blower or other suitable air supply, for example as provided in U.S. Pat. No. 5,944,494 to Soltani et al., which is assigned to the assignee of the present invention and the disclosure of which is expressly incorporated by reference herein. Additional embodiments of air supply 20 include a fan, a blower, compressor, or any other suitable air supply known to those skilled in the art. In the embodiment of FIG. 1, the air enters interior region 18 through inlet valve 16 and exits through the apertures 22. In the embodiment of FIG. 2, an outlet 17 is provided on the end 8 opposite inlet valve 16 for air to be released to the atmosphere.

Figure 3:
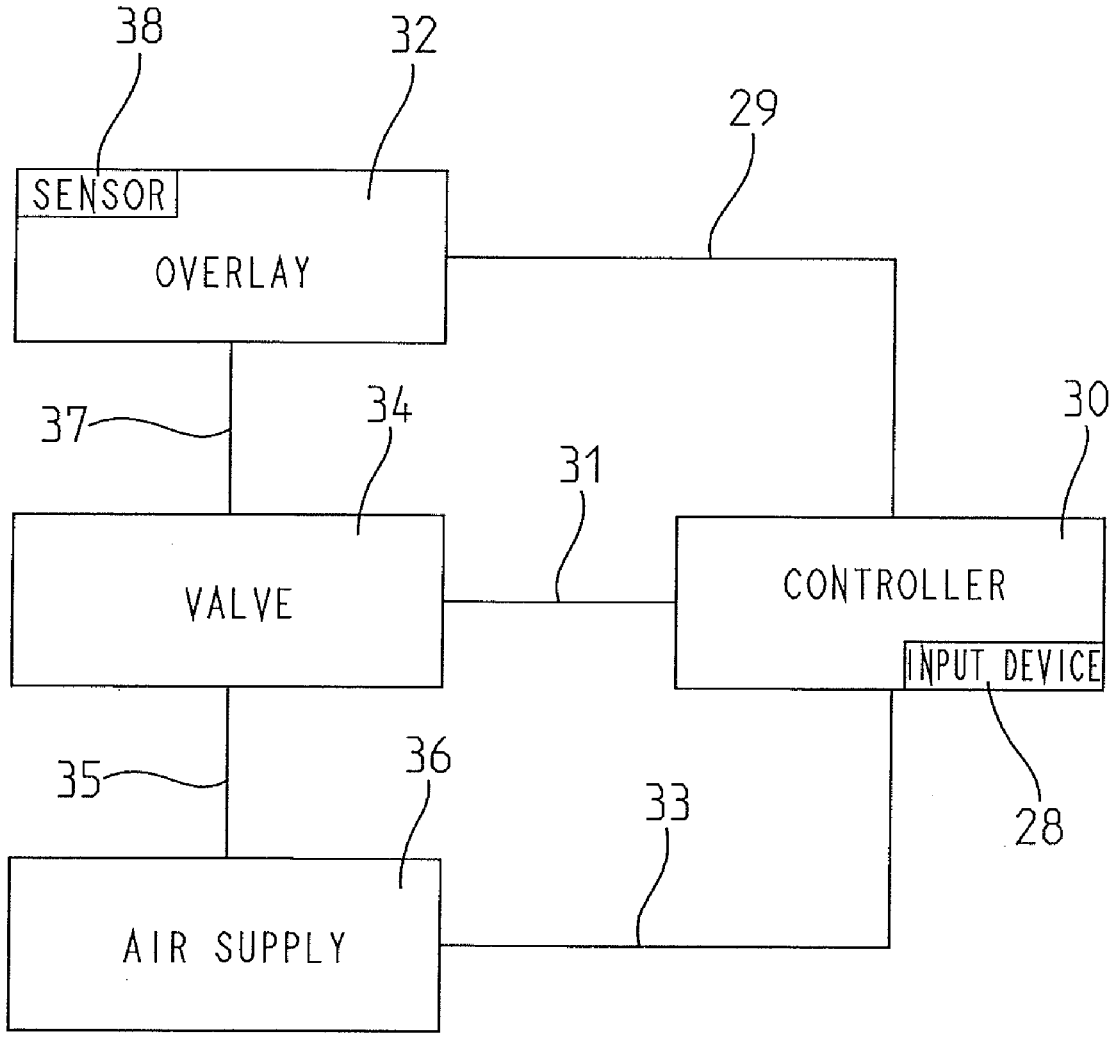
FIG. 3 is a simplified block diagram illustrating components of an overlay in accordance with the present invention.

FIG. 3 is a simplified block diagram of a system including an overlay in accordance with the present invention. The illustrated system may be independent of, or integrated with, a bed or mattress control system such as may be used to control features and/or therapies of a mattress or hospital bed.

As shown in FIG. 3, a controller 30 is electronically coupled to an overly 32, valve 34, and air 36 via lines 29, 31, 33. Lines 29, 31, 33 may be copper wire, wireless, or other suitable connection for transmitting electrical signals. Overlay 32 is mechanically coupled to one or more valves 34 by coupler 37, which are mechanically coupled to one or more air supplies 36 by coupler 35. Couplers 35, 37 may be hoses, plastic tubing, or other suitable couplers for transferring air to the overlay 32. Additionally, controller 30 may be electrically coupled to an outlet valve such as valve 17 to control the rate at which air escapes the interior region of the overlay.

In a simplified arrangement, controller 30 is only coupled to valve 34 and air supply 36 so as to regulate air flow into the overlay 32. However, in the illustrated embodiment controller 30 is also coupled to the overlay 32. The overlay 32 is provided with a sensor 38, which provides information to controller 30. Controller 30 uses the information to regulate air flow to overlay 32.

In one embodiment, sensor 38 is a humidity detector. If humidity detector 38 detects a humidity level inside the interior region of overlay 32 that is greater than a predetermined threshold amount, the controller 30 will activate the air supply 36 and open the valve 34 to supply air to the overlay. If air is already being supplied to overlay 32, controller 30 may increase the rate or volume at which air is supplied through valve 34 by air supply 36.

Alternatively or in addition, sensor 38 may include a pressure detector such that the supply of air flowing into overlay 32 may be adjusted (i.e., increased or decreased) based on a pressure detected by the sensor 38. The internal air pressure within the interior region of the overlay 32 and/or an interface pressure between the top surface 12 of the overlay and a patient positioned thereon may be measured by sensor 38 and monitored by controller 30. Other conditions that may be sensed by a sensor 38 and monitored by controller 30 as described above include, for example, temperature within the interior region, and weight of a patient positioned on the overlay.

In general, controller 30 may be used to turn on or off the flow of air into or out of overlay 30, and/or to increase or decrease the rate or volume of such air flow, either in response to input received from a sensor 38, or in response to input provided by a patient or caregiver, e.g. through a switch, button, or user interface 28.

A method of improving air flow is also provided. As shown in FIG. 2, overlay 10 is provided and placed on a mattress 24. Air source 20 provides air that travels through valve 16 and into interior region 18. Air passes through 3D material 19 and exits overlay 10 through holes 22 in cover 12. Alternatively, or in addition, air may exit through an outlet 17 as noted above. This allows air to circulate under a patient positioned above the overlay 10. 3D material 19 provides support for the patient without affecting the interface pressure between the mattress and the patient. The weight of patients will vary and overlay 10 is operable to support either a bariatric or non bariatric patient.

Figure 4:
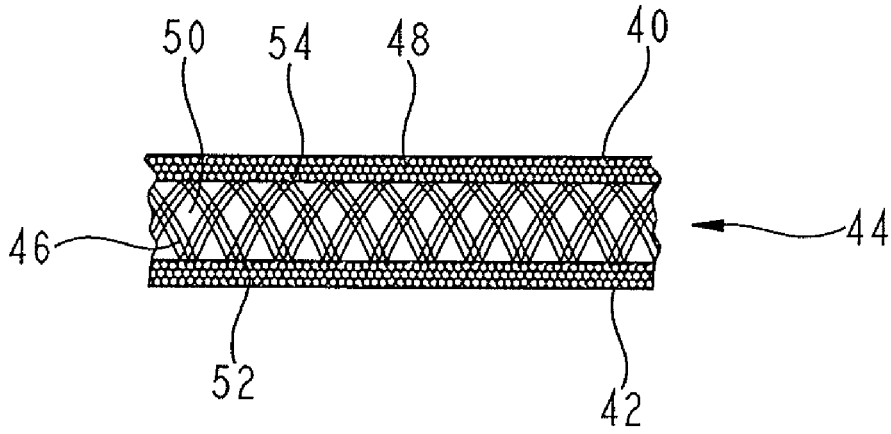
FIG. 4 is a simplified cross-sectional view of an exemplary three-dimensional material taken along line 4-4 of FIG. 1.
Figure 5:
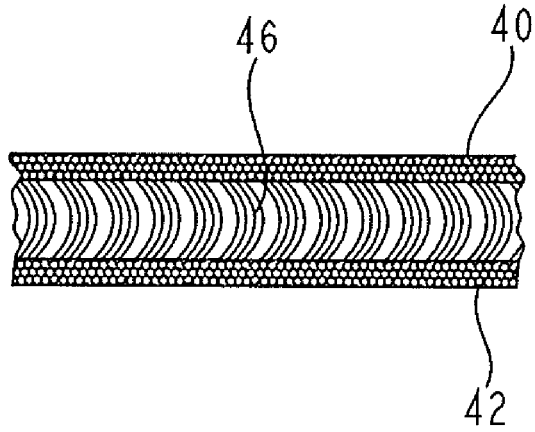
FIG. 5 is another simplified cross-sectional view of the three-dimensional material of FIG. 4 taken along line 5-5 of FIG. 1.

FIGS. 4 and 5 illustrate simplified cross sections of an exemplary 3D layer 19, taken across 4-4 and 5-5 of FIG. 1, respectively. The illustrated 3D layer 19 includes a top portion 40, a bottom portion 42 and a middle region 44. Middle region 44 includes a plurality of support fibers 46 and air spaces 50.

Top and bottom portions 40, 42 of 3D layer 19 include a cloth or fabric having knit or woven fibers, threads, or strands 48. The support fibers 48 are arranged in between the top and bottom portions 40, 42. Each fiber 48 has at least a first portion 52 coupled to bottom portion 42 and a second portion 54 coupled to top portion 40. As shown, the support fibers 46 are substantially vertically oriented between the top and bottom portions 40, 42. Spaces 50 are provided between the fibers 46 to allow air to circulate through the 3D layer 19. The density of fibers 46 within middle portion 44 determines the level of airflow through the material, as well as the support strength of the material. In general, as the density of fibers 46 increases, the air flow decreases and the support strength increases. In the illustrated embodiments, airflow is generally in the range of about zero to about 19 CFM.

The configuration of middle portion 44 and top and bottom portions 40, 42 results in a springy, stretchy, resilient material that is capable of providing cushioning, support and is stretchable in longitudinal and lateral directions.

Preferably, instructions for the assembly, installation, and/or use of overlay 10 are provided with overlay 10 or otherwise communicated to permit a person or machine to assemble, install and/or use overlay 10. Such instructions may include a description of any or all portions of overlay 10 and/or any or all of the above-described assembly, installation, and use of overlay 10 or components of overlay 10. The instructions may be provided on separate papers and/or on the packaging in which overlay 10 is sold or shipped. These instructions may also be provided over the Internet or other communication system. Furthermore, the instructions may be embodied as text, pictures, audio, video, or any other medium or method of communicating instructions known to those of ordinary skill in the art.

Although the invention has been described in detail with reference to certain preferred embodiments, variations and modifications exist within the scope and spirit of the present invention.

The invention claimed is:

1. A mattress overlay comprising:

a cover;

a base coupled to the cover;

an interior region defined by the base and the cover;

a valve operably controllable by a controller to regulate air flow to the interior region;

an air supply operably coupled to the valve and configured to provide air to the interior region; and a fiber network located within the interior region; the fiber network including a top portion, a bottom portion, and a middle portion, the middle portion including a plurality of fibers and air spaces, the fibers each having a first portion coupled to the top portion and a second portion coupled to the bottom portion.

2. The mattress overlay of claim 1, wherein the cover includes a plurality of apertures configured to allow air to pass through the cover.

3. The mattress overlay of claim 1, wherein the base is formed from a breathable material.

4. The mattress overlay of claim 1, wherein the top and bottom portions include a woven material.

5. The mattress overlay of claim 1, wherein the fiber network includes resilient fibers.

6. The mattress overlay of claim 1, wherein the fiber network is stretchable in at least two directions.

7. The mattress overlay of claim 1, wherein the mattress overlay includes first and second spaced apart longitudinal sides and first and second spaced apart ends, and the fiber network is secured to at least one of the sides and ends.

8. The mattress overlay of claim 7, wherein the fiber network is secured by at least one coupler within the interior region.

9. The mattress overlay of claim 1, wherein the mattress overlay includes first and second spaced apart longitudinal sides and first and second spaced apart ends defined by at least one dimension of the base and the cover and the at least one dimension of the base and the cover are sized to support at least a portion of a patient.

10. The mattress overlay of claim 9, wherein the at least one dimension is sized to correspond to a dimension of a patient support upon which the mattress overlay is to be placed.

11. The mattress overlay of claim 1, wherein the mattress overlay includes first and second spaced apart longitudinal sides and first and second spaced apart ends and the valve is coupled to the first end.

12. The mattress overlay of claim 11, further composing an outlet valve coupled to the second end.

13. A mattress overlay comprising:

a cover defining an interior region, a three-dimensional fiber network located in the interior region, an inlet valve coupled to the interior region, an air supply coupled to the inlet valve, and a controller coupled to the inlet valve and the air supply to control air flow from the air supply to the interior region of the overlay.

14. The mattress overlay of claim 13, wherein the cover includes a top portion and a bottom portion coupled to the top portion at an edge, and the cover has first and second spaced apart longitudinal sides and first and second spaced apart ends.

15. The mattress overlay of claim 14, wherein the three dimensional fiber network is coupled to at least one of the sides and ends of the cover.

16. The mattress overlay of claim 14, wherein the fiber network has an outer edge substantially aligned with the edge of the cover.

17. The mattress overlay of claim 13, wherein the level of air flow from the air supply to the interior region is adjustable, further comprising a sensor located within the interior region, wherein the sensor detects a condition and transmits information about the condition to the controller, and the controller adjusts the air flow from the air supply to the interior region based on information received by the controller.

18. The mattress overlay of claim 17, wherein the condition is at least one of: humidity within the interior region, air pressure within the interior region, pressure at an interface between the cover and a patient positioned on the overlay, temperature within the interior region, weight of a patient positioned on the overlay.

19. The mattress overlay of claim 13, wherein the controller includes an input device, the controller receives input through the input device from one of a patient and a caregiver and the controller adjusts the air flow from the air supply to the interior region based on the input.

20. A method of improving air flow under a patient, the method comprising the steps of:

providing a patient support configured to support a patient;

providing an overlay, the overlay including a cover having a plurality of apertures, a base coupled to the cover, an interior region defined by the cover and the base, a valve operably coupled to a controller to control air flow to the interior region, and a fiber network located within the interior region;

positioning the overlay above the patient support; and forcing air from an air supply into the interior region via the valve allowing air to exit the interior region through the plurality of apertures.

21. The mattress overlay of claim 1, wherein the valve is a check valve.

22. The mattress overlay of claim 13, wherein the valve is a check valve.

23. The mattress overlay of claim 13, wherein the cover includes a plurality of apertures on a top side thereof configured to allow air to pass therethrough.

24. The mattress overlay of claim 13, wherein the mattress overlay includes first and second spaced apart longitudinal sides and first and second spaced apart ends and the inlet valve is coupled to the first end.

25. The mattress overlay of claim 24, further composing an outlet valve coupled to the second end.

26. The mattress overlay of claim 20, wherein the valve is acheck valve.

* * * * *